United States Patent [19]

Maier et al.

[11] 4,277,664

[45] Jul. 7, 1981

[54] CIRCUIT BREAKER STRUCTURE

[75] Inventors: Alfred E. Maier; Louis N. Ricci, both of Chipperva Township, Beaver County, Pa.

[73] Assignee: Westinghouse Electric Corp., Pittsburgh, Pa.

[21] Appl. No.: 69,667

[22] Filed: Aug. 24, 1979

[51] Int. Cl.[3] ..... H01H 9/02

[52] U.S. Cl. ..... 200/293; 200/304

[58] Field of Search ..... 339/63 R, 63 M, 196 R, 339/196 M; 200/293, 304, 297, 153 G, 48 R, 305; 361/376; 335/202, 278

[56] References Cited

U.S. PATENT DOCUMENTS

| | | | |
|---|---|---|---|
| 2,191,384 | 2/1940 | Herman | 339/63 R |
| 3,328,647 | 6/1967 | Gryctko | 361/376 |
| 3,538,390 | 11/1970 | Yorgin | 361/376 |
| 3,590,199 | 6/1971 | Maier | 200/293 |
| 3,821,607 | 6/1974 | Matsko et al. | 200/293 |

*Primary Examiner*—John W. Shepperd
*Attorney, Agent, or Firm*—L. P. Johns

[57] ABSTRACT

A circuit breaker structure comprising a multipole circuit breaker having separable contacts for each pole, which circuit breaker is contained within an insulating housing; incoming and outgoing terminals extending from one wall of the housing which incoming terminals are aligned and reinforced against movement due to short circuits by a brace extending between and around the terminals on one side and a cap on the other side of the terminals for clampingly holding the aligned terminals in place.

2 Claims, 6 Drawing Figures

CIRCUIT BREAKER STRUCTURE

BACKGROUND OF THE INVENTION

1. Field of the Invention

This invention relates to a circuit breaker structure having reinforced external terminals.

2. Description of the Prior Art

Circuit interrupters having larger ratings, such as the draw-out type breaker or metal-enclosed switchgear, are provided with multiple connectors on each pole to multiply the number of contact areas in order to minimize electrical resistance and the resulting heat generated thereby. Associated with such structures is the problem of increased short circuits in high rating circuit breakers, such as 100,000 to 150,000 amperes. When a short circuit occurs in such breakers, high magnetic forces developed from the current often cause the rear connectors, draw-out stabs or bus connectors to deform and thereby damage the circuit breaker and surrounding structure.

SUMMARY OF THE INVENTION

It has been found in accordance with this invention that the foregoing problem may be overcome by providing a circuit breaker structure comprising a multipole circuit breaker having separable contacts for each pole, an insulating housing for said circuit breaker and comprising front and rear end walls, each pole for said circuit breaker comprising at least two vertically spaced incoming and outgoing terminals extending from the rear end wall, the incoming terminals for all poles being horizontally spaced and aligned on one horizontal axis, the outgoing terminals for all poles being horizontally spaced and aligned on another horizontal axis and vertically spaced from that of the incoming terminals, terminal reinforcement means for supporting the terminals against movement in response to magnetic forces when a short circuit occurs, said means extending between and around the terminals on the outer side of the rear wall, the means having apertures through which the terminals extend, the means being disposed between incoming terminals and between outgoing terminals, the means comprising a brace and a cap, which brace extends along one side of at least one of first aligned terminals, the cap extending along the other side of the first aligned terminals, attachment means for securing the brace and cap in clamping engagement with the aligned terminals, a second brace extending along one side of the second aligned terminals, a second cap extending along the other side of the second aligned terminals, and other attachment means for securing the second brace and cap together to clamp the second aligned terminals in place.

The advantage of the circuit breaker structure of this invention is that the reinforcement means is an option available for an otherwise standard circuit breaker structure which reinforcement means prevents the connectors for high rating circuit breakers from moving apart in the line and load directions, and from moving in the phase-to-phase direction.

DESCRIPTION OF THE PREFERRED EMBODIMENTS

Figure 1:
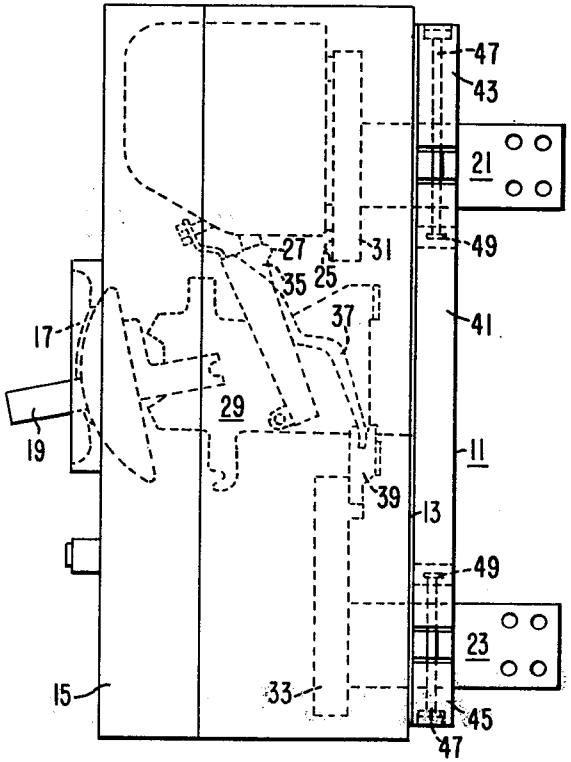
FIG. 1 is a side elevational view of a circuit breaker having incoming and outgoing rear terminals with reinforcing means.

In FIG. 1 a circuit breaker is generally indicated at 11 and it comprises a large molded-case type of breaker, such as disclosed in Canadian Pat. No. 693,476, issued Sept. 1, 1964, for which reason only a limited description is included herein. The circuit breaker 11 includes an enclosure comprising a base 13, a removable cover 15, both of which may be molded from suitable insulating material such as a thermosetting resin. The cover 15 includes an opening 17 through which a manually operated handle 19 extends, which handle is shown in the "off" position.

The circuit breaker 11 is of the three-pole type, each pole being provided with incoming and outgoing terminal structures or terminals indicated generally at 21 and 23 at spaced locations on the base 13. The circuit breaker includes, for each pole unit, a stationary contact 25, and a movable contact 27. A common operating mechanism, indicated generally at 29, is provided for simultaneous actuation of the three movable contacts to open and closed positions of the contacts 25, 27 upon manual operation of the handle 19.

The terminal structures 21, 23 are attached to stationary conductors 31, 33, respectively, which are secured by suitable means to the base 13. A path of travel of the circuit through the breaker extends from the terminal structure 21 to the conductor 31, the stationary contact 25, the movable contact 27, a contact arm 35, flexible conductors or shunts 37, the conductor strip 39, the conductor 33, and the structure or terminal 23.

Figure 2:
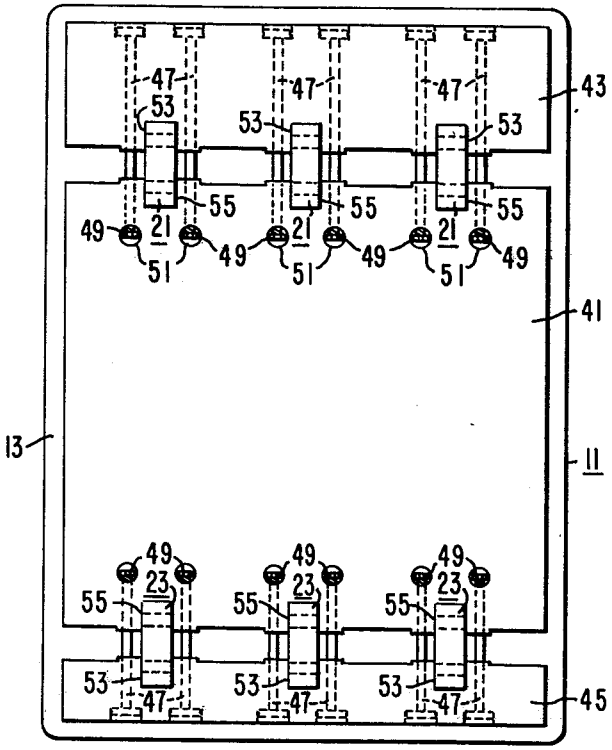
FIG. 2 is a rear elevational view of the device shown in FIG. 1.

As shown in FIG. 2 reinforcing means for the terminals 21, 23 are provided on the rear wall of the base 13. The reinforcing means comprises a plate or brace 41 and end members or caps 43, 45. The reinforcement means also comprises tiers of spaced attachment means such as pairs of spaced screws 47 and nuts 49. The screws 47 extend through aligned holes in the caps 43 and the brace 41 with the nuts 49 being removably disposed in holes 51 in the brace. The caps 43, 45 comprise spaced notches 53 and the brace 41 includes spaced notches 55 which are aligned with the notches 53.

The incoming terminals 21 at the upper side of the circuit breaker 11 are vertically disposed whereby they are seated in the aligned notches 53, 55. For illustration, the outgoing terminals 23 below the terminals 21 are vertically disposed as distinguished from their vertical disposition as shown in FIG. 1. In the horizontal position (FIG. 2) the outgoing terminals 23 are clamped between the brace 41 and the cap 45 where they are retained against lateral movement by the screws 47 which extend through holes in the terminals aligned with corresponding holes in the brace and cap. Thus, the brace 41, the caps 43, 45, and the screws 47 cooperate to reinforce the terminals 21, 23 in either position with the notches 53, 55, holding the incoming terminals 21 in place in cooperation with the screws 47 for holding the cap 43 in position at the upper end of the brace 41. Manifestly, the brace 41, being disposed between the upper incoming terminals 21 and the lower outgoing terminals 23 holds those terminals in place against any forces that would otherwise cause the terminals to move toward each other.

Figure 3:
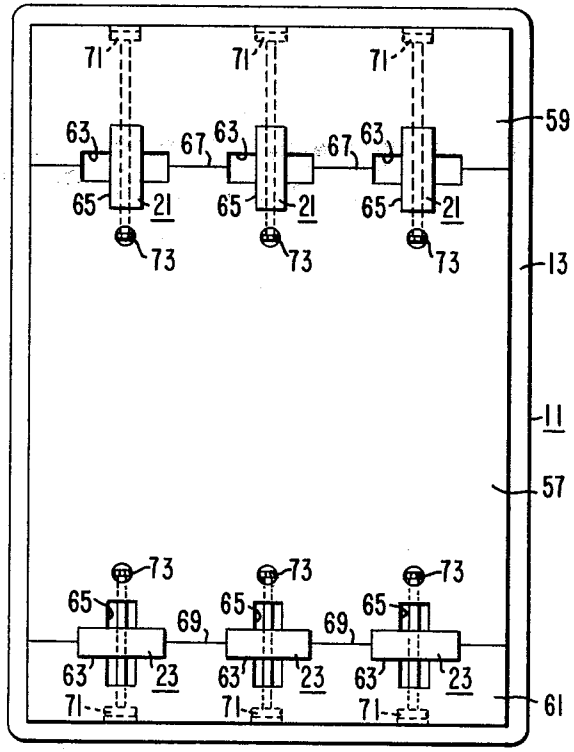
FIG. 3 is a rear elevational view of another embodiment.

Another embodiment of the invention is shown in FIG. 3 in which similar numerals refer to similar parts. In this embodiment the reinforcing means comprising a brace 57 and caps 59, 61 differ from those of FIG. 2. When assembled with the brace 57, the caps 59, 61 form similar horizontal notches 63 and vertical notches 65 to accommodate either vertically or horizontally disposed terminals 21, 23 as shown. In addition, the brace 57 and the caps 59, 61 include adjacent portions that abut each other at edges 67, 69, whereby the abutting portions are disposed between spaced terminals 21, 23. The caps 59, 61 are clamped in place by spaced screws 71 having nuts 73 similar to the screws 47 and nuts 49 of FIG. 2.

Figure 4:
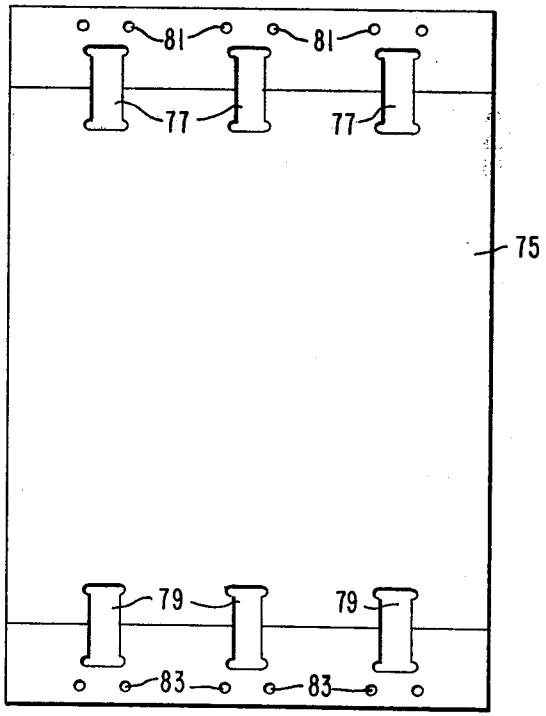
FIG. 4 is a plane view of another embodiment of a reinforcing plate.

Another embodiment of the invention is shown in FIG. 4 which comprises a brace 75 having spaced holes 77 for incoming terminals 21 and lower holes 79 for outgoing terminals. In this embodiment of the invention both upper and lower holes 77, 79 are vertically disposed to accommodate similarly disposed incoming and outgoing terminals. The brace 75 comprises a plurality of holes 81, 83 by which the brace is attached to the rear wall of the circuit breaker 11 by suitable means such as bolts (not shown).

Figure 5:
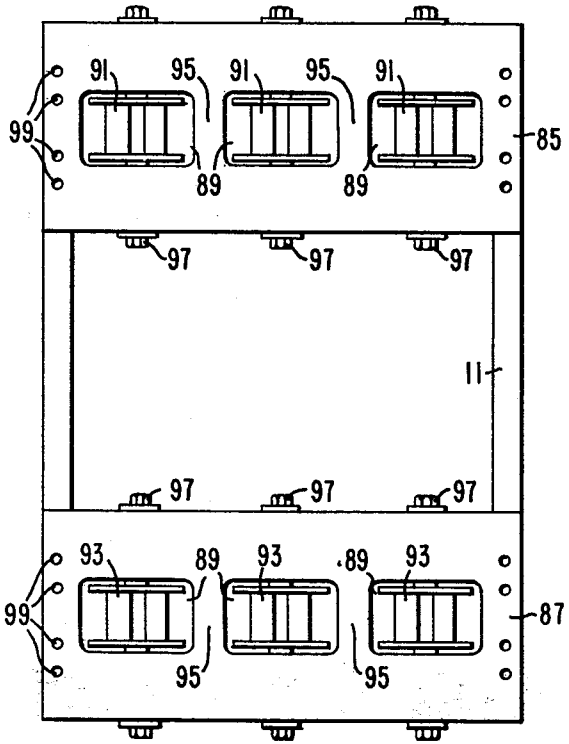

Still another embodiment of the invention is shown in FIG. 5 in which a pair of spaced braces 85, 87 are provided. The braces 85, 87, being similar in construction are substantially rectangular members having spaced openings 89 through which terminals 91, 93 extend. The braces 85, 87 comprise similar intermediate portions between the openings 89 for preventing the horizontally spaced terminals 91 from moving laterally under the influence of excessive magnetic forces incurred by high short circuits. The portion 95 serve the same purpose for the outgoing terminals 93. In addition, spaced bolts 97 extend through aligned holes in the assembled braces and corresponding terminals for retaining the assembly together. Finally, bolts 99 secure the braces 85, 87 in place on the back of the circuit breaker 11.

Figure 6:
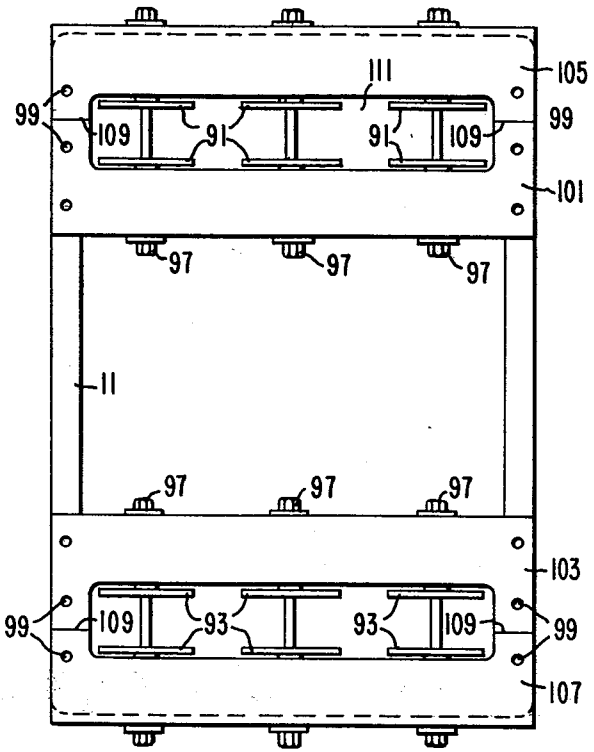
FIGS. 5 and 6 are elevational views of other embodiments of the device of this invention.

Still another embodiment of the invention is shown in FIG. 6 in which upper and lower brace means are provided which include braces 101, 103 having detachable portions 105, 107, respectively. The portions 105, 107 having parting surfaces 109 with adjoining braces 101, 103. Each pair of braces 101, 103 and portions 105, 107 form similar openings 111 in which laterally spaced terminals 91 are disposed on the upper side and terminals 93 are disposed on the lower side. The upper and lower braces 109, 103 and portions 105, 107 are retained in place by mounting bolts 99. Similarly the bolts 97 extend between each pair of braces and brace portions such as the braces 101 and portion 105 as well as the brace 103 and portion 107.

In conclusion, the device of this invention provides reinforcement means for retaining spaced incoming and outgoing terminals in place against movement otherwise caused by magnetic forces incurred by excessive short circuits. The reinforcement devices are used in conjunction with circuit breakers where the latter are usable for much higher ratings such as 100,000 and 150,000 amperes and thereby require the reinforcement means.

What is claimed is:

1. A circuit breaker structure comprising a multi-pole circuit breaker having separable contacts for each pole, an insulating housing for said circuit breaker and comprising front and rear end walls, each pole for said circuit breaker comprising at least two vertically spaced incoming and outgoing terminals extending from the rear end wall, the incoming terminals for all poles being horizontally spaced and aligned on one horizontal axis, the outgoing terminals for all poles being horizontally spaced and aligned on another horizontal axis and vertically spaced from that of the incoming terminals, terminal reinforcement means for supporting the terminals against movement in response to magnetic forces when a short circuit occurs, said means extending between and around the terminals on the outer side of the rear end wall, and the means comprising a separable brace and cap assembly which brace extends along one side of at least one of first aligned terminals, the cap extending along the other side of the first aligned terminals, and attachment means for securing the brace and cap into clamping engagement with the aligned terminals.

2. The circuit breaker structure of claim 1 in which the means comprises a second brace and cap assembly of which the brace extending along one side of second aligned terminals, a second cap extending along the other side of the second aligned terminals, and attachment means for securing the second brace and cap assembly together to clamp the second aligned terminals in place.

* * * * *